US005655674A

United States Patent [19]

Holztrager

[11] Patent Number: 5,655,674

[45] **Date of Patent: *Aug. 12, 1997**

[54] EXHIBIT PANEL WITH LIGHTWEIGHT HOLLOW BACKBOARD

[76] Inventor: William J. Holztrager, Packing House Rd., Chilhowie, Va. 24319

[ * ] Notice: The term of this patent shall not extend beyond the expiration date of Pat. No. 5,431,761.

[21] Appl. No.: 507,720

[22] Filed: Jul. 26, 1995

[51] Int. Cl.[6] ..... A47G 5/00; B32B 31/02

[52] U.S. Cl. ..... 211/94.01; 52/36.4; 52/793.11; 211/87.01

[58] Field of Search ..... 156/153, 290, 156/292; 160/135, 351; 211/94, 87; 52/71, 239, 582.1, 716, 792, 808, 829, 36.4, 793.11

[56] References Cited

U.S. PATENT DOCUMENTS

| | | | |
|---|---|---|---|
| 3,664,906 | 5/1972 | Hartig . | |
| 4,391,375 | 7/1983 | Joyce . | |
| 4,572,381 | 2/1986 | Breakey et al. . | |
| 4,591,058 | 5/1986 | Amstutz et al. . | |
| 4,629,076 | 12/1986 | Amstutz et al. . | |
| 4,752,010 | 6/1988 | Holztrager . | |
| 4,944,416 | 7/1990 | Petersen et al. . | |
| 5,125,193 | 6/1992 | Beaulieu . | |
| 5,431,761 | 7/1995 | Holztrager . | |
| 5,450,694 | 9/1995 | Goranson et al. | 160/135 X |

OTHER PUBLICATIONS

Slocum Adhesives Corporation, Material Safety Data Sheet for R–6060.

The Sherwin–Williams Company, Manufacturer's Data Sheet POLANE* 2.8T.

The Sherwin–Williams Company, Material Safety Data Sheet for POLANE Plus Catalyst.

DSM Chemicals North America, Inc., Certificate of Analysis for Cyclohexanone.

Ashland Chemical Company, Material Safety Data Sheet for Adhesive Promoter.

Lokweld Adhesives, Manufacturer Brochure for 1055/1056 Contact Adhesive Exhibit Builder, Article entitled "Fire Safety Update" by Scott Gray.

CO–EX, Manufacturer's Brochure for macrolux General Electric, Manufacturer's Brochure for LEXAN® THERMOCLEAR* Sheet.

GE Plastics, Product Warranty for LEXAN® THERMOCLEAR* Sheet GE Plastics, Product Literature entitled "Cut Your Energy Costs Protect . . . ".

Shields, J. *Adhesives Handbook*, CRC Press, 1970, pp. 244–246, 263 and 264.

GE Plastics, Manufacturer's Brochure for LEXAN Thermoclear® Flex–Lite.

GE Plastics, Manufacturer's Brochure for LEXAN® Sheet For Architectural Glazing.

Nationwide Displays, Manufacturer's Brochure for Custom Exhibits for Lease or Purchase.

*Primary Examiner*—Jeff H. Aftergut

*Attorney, Agent, or Firm*—Shlesinger, Arkwright & Garvey LLP

[57] ABSTRACT

An exhibit panel comprises a backboard made of plastic material having a pair of spaced apart walls secured by a plurality of spaced apart longitudinal ribs disposed between the walls; and a plurality of parallel spaced apart longitudinal profiles glued to the backboard.

8 Claims, 2 Drawing Sheets

EXHIBIT PANEL WITH LIGHTWEIGHT HOLLOW BACKBOARD

FIELD OF THE INVENTION

The present invention relates generally to a display wall panel for use in displaying merchandise in retail stores, trade shows or the like and particularly to a slatwall construction utilizing light-weight and relatively fire resistant materials. The present invention also pertains to a decorative panel.

BACKGROUND OF THE INVENTION

The National Fire Protection Association (NFPA) is putting tremendous pressure on the exhibit industry to require all materials used in the construction of exhibit booths to have a Class A fire rating. Present materials used include wood and wood products. There is therefore a need for exhibit panel construction that is relatively fire resistant that meets the NFPA fire safety code.

Weight is a major consideration when selecting materials to build exhibit booths and displays. Exhibit booths typically use knock-down construction, so that they can be shipped in compact containers to various locations where trade shows, conventions or the like are held. These booths are typically reusable. Thus, relatively heavy materials would cost more to ship and handle. There is therefore a need for light-weight exhibit panel construction that would be relatively cheaper to handle and ship.

OBJECTS AND SUMMARY OF THE INVENTION

It is an object of the present invention to provide an exhibit panel that meets NFPA requirements on fire safety for construction of exhibit booths and display walls.

It is another object of the present invention to provide a exhibit panel that is relatively light-weight as compared to prior art construction.

It is still another object of the present invention to provide an exhibit panel that utilizes standard slatwall hardware and would carry relatively more weight than any of the slatwall products currently being used.

It is another object of present invention to provide an exhibit panel that is finished with a coating that is compatible with the polycarbonate plastic material used.

It is another object of the present invention to provide an exhibit panel that is relatively inexpensive to manufacture.

These and other objects of the present invention will become apparent from the following detailed description.

BRIEF DESCRIPTIONS OF THE DRAWINGS

DETAILED DESCRIPTION OF THE INVENTION

Figure 1:
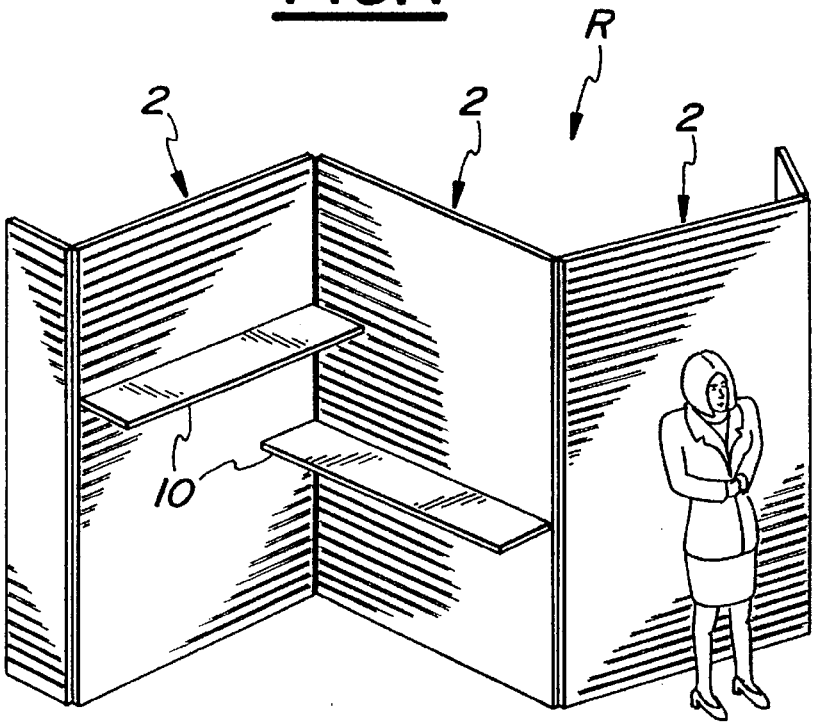
FIG. 1 is a perspective view of an exhibit display booth using the exhibit panel of the present invention.
Figure 2:
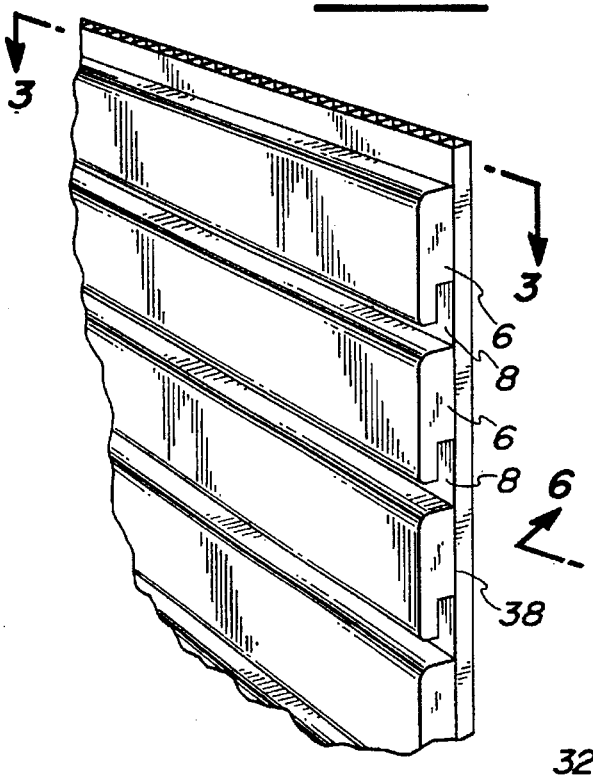
FIG. 2 is an enlarged, fragmentary perspective view of the exhibit panel of the present invention.

An exhibit display booth R comprises a plurality of exhibit panels 2 made in accordance with the present invention, as best shown in FIG. 1. The exhibit panel 2 is a slatwall construction comprising a backboard 4 and a plurality of longitudinal profiles or support members 6, as best shown in FIG. 2. The profiles 6 are spaced in parallel relationship, thereby forming horizontal grooves 8 between adjacent profiles 6. The horizontal grooves 8 are adapted to support shelves 10 or other supporting members (not shown) on which merchandise is placed for display. Typically, the shelves 10 are braced from underneath with wood or metal brackets (not shown).

The profiles 6 may be of any specific cross-sectional configuration, depending on the application for the exhibit panel 2. In the configuration illustrated in FIG. 2, the profiles 6 may be used to support a plurality of brackets for supporting the shelves 10. The profiles 6 are preferably constructed of Celuka polyvinyl chloride, or may be constructed of fiber board, particle board, polyvinyl chloride or wood.

The backboard 4 is a polycarbonate architectural glazing sheet material available from GE Plastics, Pittsfield, Mass., under the name LEXAN THERMOCLEAR, or from CO-EX Corporation, Rocky Hill, Conn. under the name MACROLUX. Prior to the present invention, the backboard 4 has been known to be used only for windows, skylights, greenhouses, etc.

The flammability of backboard 4 is classified as self-extinguishing and when compared with other thermoplastic products used in the building industry, it does not encourage flames. The backboard 4 does not give off toxic gases.

Figure 3:
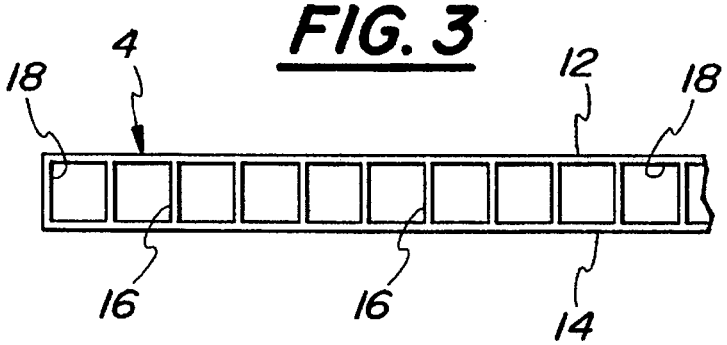
FIG. 3 is a cross-sectional view taken along line 3—3 of FIG. 2, showing the structure of the backboard used in the exhibit panel of the present invention.
Figure 7:
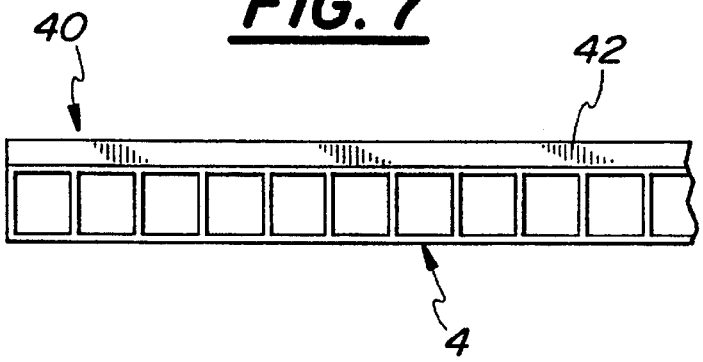
FIG. 7 is a cross sectional view of another embodiment of the exhibit panel in accordance with the present invention.

The backboard 4 comprises two parallel walls 12 and 14 supported by intervening parallel spaced apart longitudinal ribs 16, defining a series of hollow square tubes 18, as best shown in FIG. 3. A person of ordinary skill in the art will appreciate that the structure of the backboard 4 advantageously provides a relatively lightweight, rigid and self-supporting product.

Figure 4:
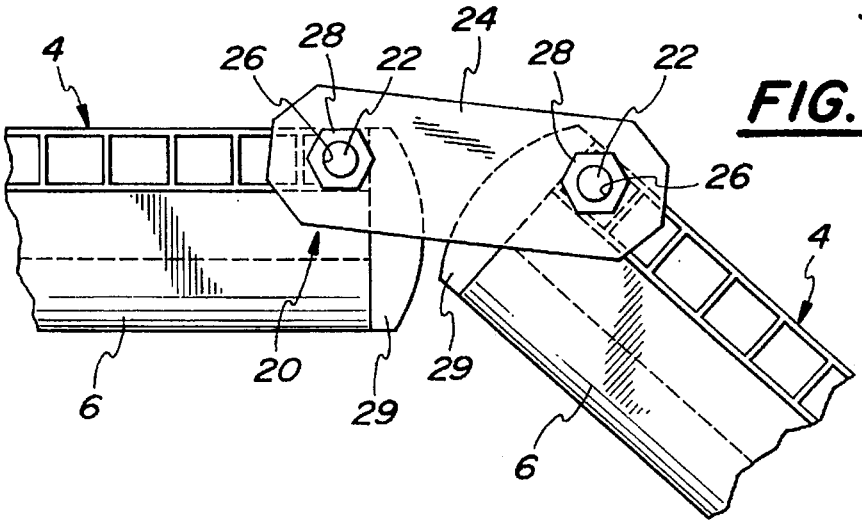
FIG. 4 is a fragmentary, enlarged, detailed view of a connection means for securing together adjacent exhibit panels.

The exhibit panels 2 may be secured to each other by means of a hinge assembly 20, as best shown in FIG. 4. The hinge assembly 20 includes a pair of threaded rods 22 that are received in respective one of the square tubes 18 of the adjacent panels 4, with end portions extending beyond opposite edges of the panels 2. A pair of brackets 24 are disposed at respective ends of the rods 22. The brackets 24 have openings 26 through which the end portions of the rods 22 extend and are secured by nuts 28 thereto, as best shown in FIG. 4. A person of ordinary skill in the art will understand that hinge assembly 20 is relatively easily disassembled, thereby permitting convenient disassembly of the exhibit display booth R for shipping. The hinge assembly 20 further permits the exhibit panels 2 to be arranged in any angular orientation as needed. Other hinge assemblies or connecting means may be used to assemble a display booth using the panels 2. Endcaps 29 may be used to dress up the exposed edges of the panels 2.

Figure 5:
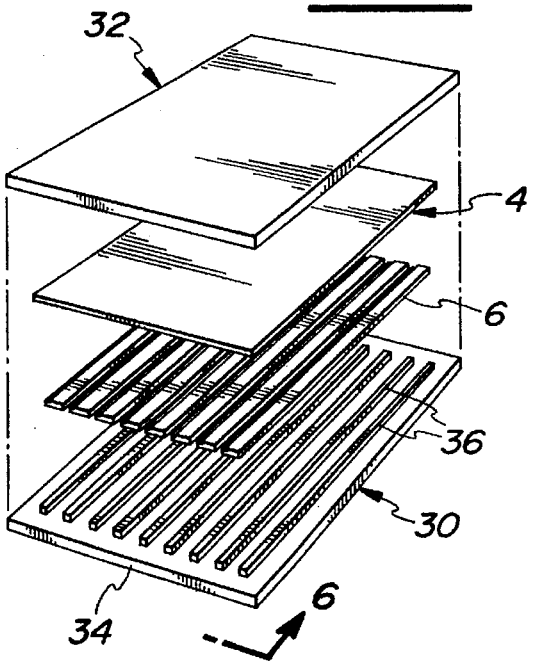
FIG. 5 is an exploded, perspective, schematic view of a process of making the exhibit panel of the present invention.
Figure 6:
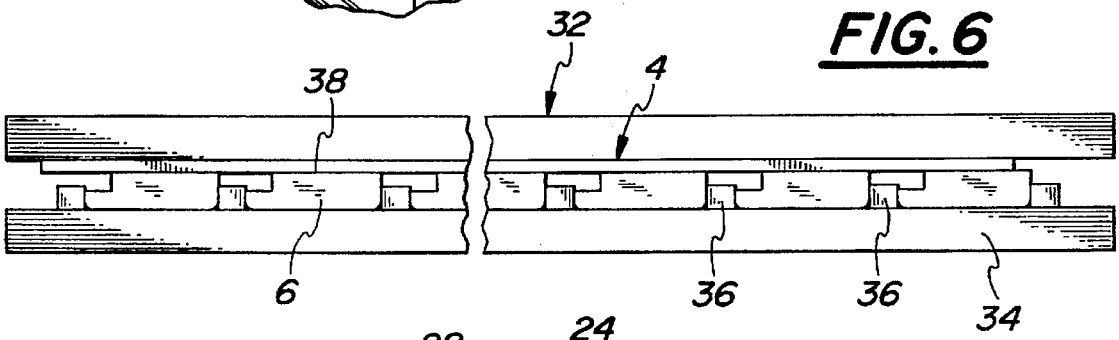
FIG. 6 is an edge view of the assembled exhibit panel in a jig and press used in the present invention, as viewed along line 6—6 of FIG. 5.

The exhibit panel 2 is assembled using a jig 30 and a press 32, shown schematically in FIG. 5. The jig 30 includes a flat board 34 onto which are secured a plurality of equally spaced and parallel spacers 36. A person of ordinary skill in the art will understand that the distance between adjacent spacers 36 will be dictated by the dimension of the profiles 6. The profiles 6 are laid face down in the jig between the spacers 36, as best shown in FIG. 6. Glue is then applied to the back surfaces 38 of the profiles 6 and the backboard 4 is then laid on the back surfaces of the profiles 6, with the ribs 16 disposed substantially at right angle to the length of the profiles 6. A person of ordinary skill in the art will understand that the transverse orientation of the ribs 16 and the profiles 6 provides a relatively stronger assembly. The contacting surface of the backboard 4 is lightly sanded before being pressed to the profiles 6. The press 32 then applies pressure to the assembly preferably at approximately 30 psi for approximately 40 minutes. The adhesive used for securing the profiles 6 to the backboard 4 is available from Slocum Adhesives Corporation, Lynchburg, Va., under the name R-6060.

The backboard 4 is available from the manufacturer as a translucent sheet, since it is used as an architectural glazing material for buildings and the like. A finish coat is therefore required. Polycarbonate is one of the difficult plastics to finish. The present invention developed a chemical coating and the process for applying the same on polycarbonate plastic.

The exhibit panel 2 is finished with a chemical coating comprising a mixture of non-lead polyurethane, a catalyst for hardening and cylohexanone as a reducer or thinner. The polyurethane used in the coating is available under the name POLANE PLUS, manufactured by Sherwin-Williams Company, Cleveland, Ohio. The catalyst used is available as POLANE PLUS Catalyst, product number V66 V 44, manufactured by Sherwin-Williams. The cyclohexanone is manufactured by DSM Chemicals North America, Inc., Augusta, Ga.

For a low luster finish, the chemical coating is mixed in the approximate proportions of four parts by volume of polyurethane, one part by volume of catalyst and one part by volume of cyclohexanone. For a high luster finish, the chemical coating is prepared by mixing approximately two parts by volume of polyurethane, one part by volume of catalyst and one part by volume of cyclohexanone.

An adhesion promoter is applied by wiping on the surfaces of the assembled exhibit panel 2 prior to applying the chemical coating. An example of an adhesion promoter is a solvent blend manufactured by Ashland Chemical Company, Roanoke, Va., under the name ADHESIVE PROMOTOR SW. The solvent blend softens the surfaces of the assembled exhibit panel 2 and provides approximately 10 minutes during which to spray the chemical coating finish. An airless air assisted sprayer is preferably used in applying the chemical coating.

The finished panel 2 is then placed in an oven at approximately 120° F. for approximately 60 minutes. This step activates the catalyst for promoting the hardening of the polyurethane. The finished panel 2 may be shipped approximately 24 hours after, but will not completely cure for approximately 7 days. The panel 2 may be handled during the curing time.

Although the exhibit panel 2 is illustrated as being used in the exhibit booth R which is freestanding, the panel 2 may also be secured to an existing structure such as drywall, wood or metal studs, etc. Preferably, contact adhesive such as LOKWELD 1055/1056, manufactured by RWP Company, Temple, Tex., is used to secured the panel 2 to the structure.

The backboard 4 may also be used to make a decorative panel 40 having a decorative laminate 42 made of wood veneer, metal, vinyl, plastic laminate, fabric, etc. The decorative laminate 42 is applied to the backboard 4 with contact cement such as that manufactured by Slocum Adhesives Corporation. The decorative panel 40 may be used on some portions of an exhibit booth or wall where slatwall construction is not desired. The panel 40 may also be used in other building construction, such as decorative walls, wall dividers, etc. It may also be used for modular wall construction for offices. A person of ordinary skill in the art will understand that the panel 40 would find numerous other applications.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An exhibit panel, comprising:

a) a backboard made of plastic material;

b) said backboard having a pair of spaced apart walls secured by a plurality of spaced apart longitudinal ribs disposed between said walls such that a plurality of hollow tubes are formed therein; and c) a plurality of parallel longitudinal profiles secured to said backboard, thereby to provide a plurality of grooves to which an article to be exhibited may be operably secured.

2. An exhibit panel as in claim 1, wherein:

a) said profiles are disposed substantially transverse to said ribs.

3. An exhibit panel as in claim 1, wherein:

a) said backboard is made of polycarbonate material.

4. An exhibit panel as in claim 1, and further comprising:

a) a chemical coating finish disposed on the exposed surfaces of said profiles and backboard.

5. An exhibit panel as in claim 1, wherein:

a) said profiles are extruded polyvinyl chloride.

6. An exhibit panel as in claim 1, wherein:

a) said backboard has self-extinguishing flammability.

7. An exhibit panel as in claim 1, wherein:

a) said profiles are glued to said backboard.

8. An exhibit panel as in claim 1, wherein:

a) said tubes are square in cross-section.

* * * * *